US011759941B1

(12) United States Patent
Henderson, Jr.

(10) Patent No.: US 11,759,941 B1
(45) Date of Patent: Sep. 19, 2023

(54) DEAD BLOW HAMMER

(71) Applicant: ROMP FASTENERS LLC, Las Vegas, NV (US)

(72) Inventor: Hollis C. Henderson, Jr., Lincolnton, NC (US)

(73) Assignee: ROMP FASTENERS LLC, Las Vegas, NV (US)

( * ) Notice: Subject to any disclaimer, the term of this patent is extended or adjusted under 35 U.S.C. 154(b) by 0 days.

(21) Appl. No.: 18/171,033

(22) Filed: Feb. 17, 2023

(51) Int. Cl.
*B25G 3/34* (2006.01)

(52) U.S. Cl.
CPC ..... *B25G 3/34* (2013.01)

(58) Field of Classification Search
CPC .... B25D 1/02; B25D 17/04–046; B25G 3/24; B25G 3/34
USPC ..... 16/436, 110; 81/489, 20, 22
See application file for complete search history.

(56) References Cited

U.S. PATENT DOCUMENTS 654,943 A * 7/1900 Butler ..... F16B 3/00 403/281
3,088,506 A * 5/1963 Bianchini ..... B25D 1/12 81/19

* cited by examiner

*Primary Examiner* — Thomas Raymond Rodgers
(74) *Attorney, Agent, or Firm* — Maschoff Brennan

(57) ABSTRACT

In an example, a hammer head may include a cavity, a receptacle channel connected to the cavity, a first wedge, and a second wedge. The receptacle channel may have a first receptacle end that may be proximate and/or open to the cavity. The receptacle channel may be configured to receive a handle and a receptacle cross-section of the receptacle channel may have an elliptic shape. The first wedge may be disposed in the receptacle channel and may have a first upper portion that may be proximate to the cavity. The first wedge may be disposed on an end of a major axis of the receptacle cross-section. The second wedge may be disposed in the receptacle channel and may be opposite the first wedge. The second wedge may have a second upper portion that may be proximate to the cavity and may be disposed on an end of the major axis.

20 Claims, 11 Drawing Sheets

DEAD BLOW HAMMER

FIELD

The embodiments discussed in the present disclosure are related to a dead blow hammer.

BACKGROUND

Through repeated use and/or time, a hammer head may experience a loosening in the attachment between the hammer head and an associated handle. For instances, as a hammer strikes another object, there may be an increase in the likelihood of the hammer head separating from the handle, which may render the hammer unusable and/or may cause a risk to the user and/or nearby bystanders. Some hammers include provisions of reducing the risk of a hammer head separating from a hammer, such as driving a wedge into an upper portion of the handle (e.g., a portion of the handle that may have passed through a channel of the hammer head) which may tighten the handle within the hammer head. In some circumstances, the provisions may not be applicable to certain types of hammer devices.

The subject matter claimed herein is not limited to embodiments that solve any disadvantages or that operate only in environments such as those described above. Rather, this background is only provided to illustrate one example technology area where some embodiments described herein may be practiced.

SUMMARY

According to an aspect of an embodiment, a hammer head may include a cavity, a receptacle channel connected to the cavity, a first wedge, and a second wedge. The receptacle channel may have a first receptacle end that may be proximate to the cavity and/or open to the cavity. The receptacle channel may be sized and shaped to receive a handle. The receptacle channel may have a receptacle cross-section that may be an elliptic shape. The first wedge may be disposed in the receptacle channel and may have a first upper portion that may be proximate to the cavity. The first wedge may be disposed on a first end of a major axis of the receptacle cross-section. The second wedge may be disposed in the receptacle channel opposite the first wedge and may have a second upper portion that may be proximate to the cavity. The second wedge may be disposed on a second end of the major axis.

In another embodiment, a hammer may include a handle and a hammer head. The handle may have a handle cross-section that may have an elliptic shape. The handle may include a slotted portion along a major axis of the handle cross-section on a hammer head end thereof. The hammer head may include a cavity, a receptacle channel connected to the cavity, a first wedge, and a second wedge. The receptacle channel may have a first receptacle end that may be proximate to the cavity and/or open to the cavity. The receptacle channel may be sized and shaped to receive a handle. The receptacle channel may have a receptacle cross-section that may be an elliptic shape. The first wedge may be disposed in the receptacle channel and may have a first upper portion that may be proximate to the cavity. The first wedge may be disposed on a first end of a major axis of the receptacle cross-section. The second wedge may be disposed in the receptacle channel opposite the first wedge and may have a second upper portion that may be proximate to the cavity. The second wedge may be disposed on a second end of the major axis.

In another embodiment, a method of fastening a handle to a hammer head may include inserting a hammer head end of a handle into a receptacle channel of the hammer head. In such instances, a slotted portion of the handle may engage a first wedge and a second wedge of the hammer head. The handle may include a handle cross-section that may have an elliptic shape. The handle may also include a slotted portion along a major axis of the handle cross-section on the hammer head end. The hammer head may include a cavity, the receptacle channel connected to the cavity, a first channel, a second channel, a first wedge, and a second wedge. The receptacle channel may have a first receptacle end that may be proximate to the cavity and/or open to the cavity. The receptacle channel may be sized and shaped to receive the handle. The receptacle channel may have a receptacle cross-section that may be an elliptic shape. The first channel may be connected to the cavity and may be oriented orthogonally to a center line through the receptacle cross-section. The first channel may be disposed in a first lateral direction relative to the cavity. The second channel may be connected to the cavity and may be oriented orthogonally to the center line through the receptacle cross-section. The second channel may be disposed on an opposite side of the cavity relative to the first channel. The first wedge may be disposed in the receptacle channel and may have a first upper portion that may be proximate to the cavity. The first wedge may be disposed on a first end of a major axis of the receptacle cross-section. The second wedge may be disposed in the receptacle channel opposite the first wedge and may have a second upper portion that may be proximate to the cavity. The second wedge may be disposed on a second end of the major axis.

The object and advantages of the embodiments will be realized and achieved at least by the elements, features, and combinations particularly pointed out in the claims.

Both the foregoing general description and the following detailed description are given as examples and are explanatory and are not restrictive of the invention, as claimed.

BRIEF DESCRIPTION OF THE DRAWINGS

Example embodiments will be described and explained with additional specificity and detail through the use of the accompanying drawings in which.

DESCRIPTION OF EMBODIMENTS

Figure 1A:
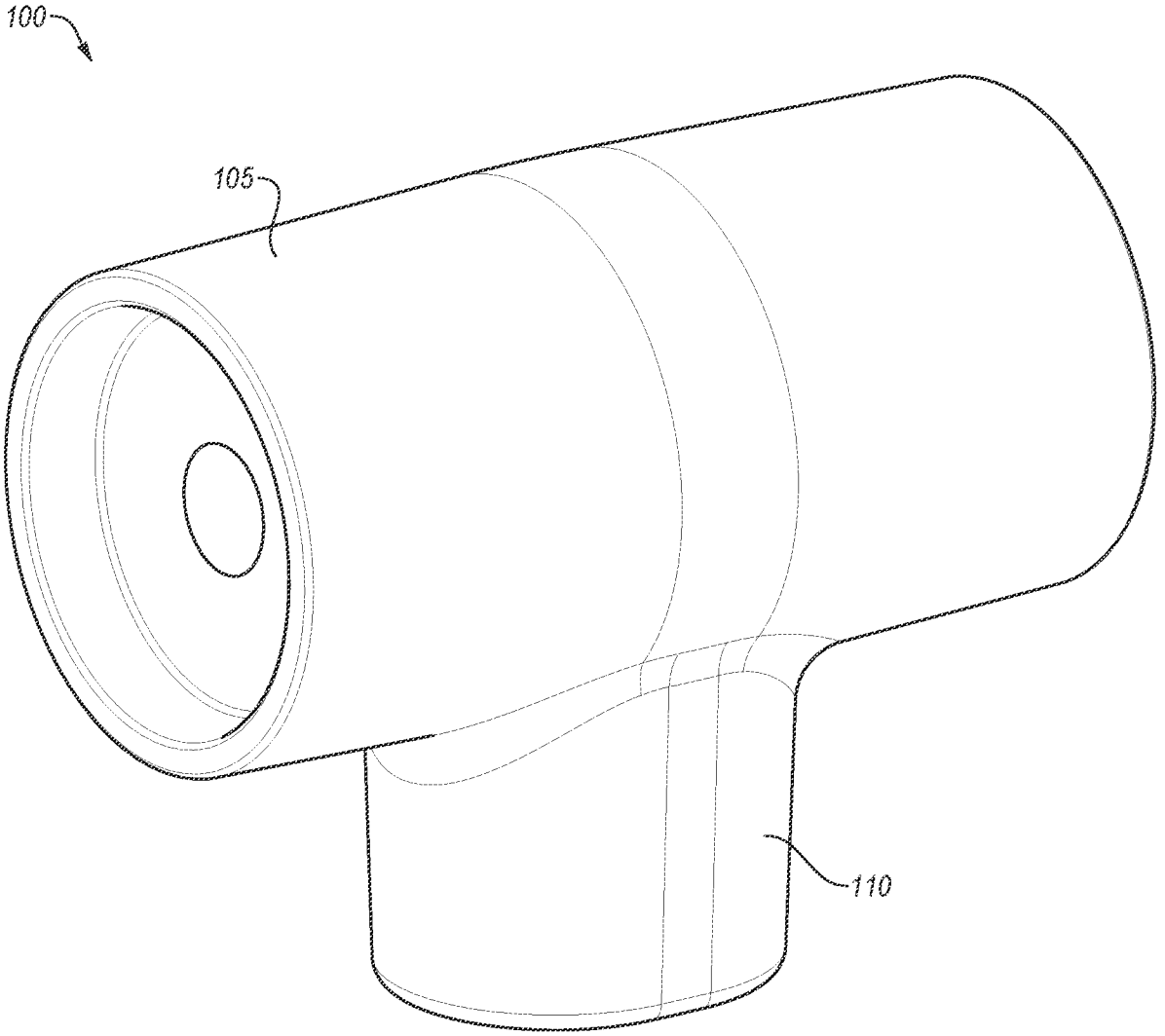
FIG. 1A illustrates an upper, perspective view of an example dead blow hammer head, according to one or more embodiments of the present disclosure.
Figure 1B:
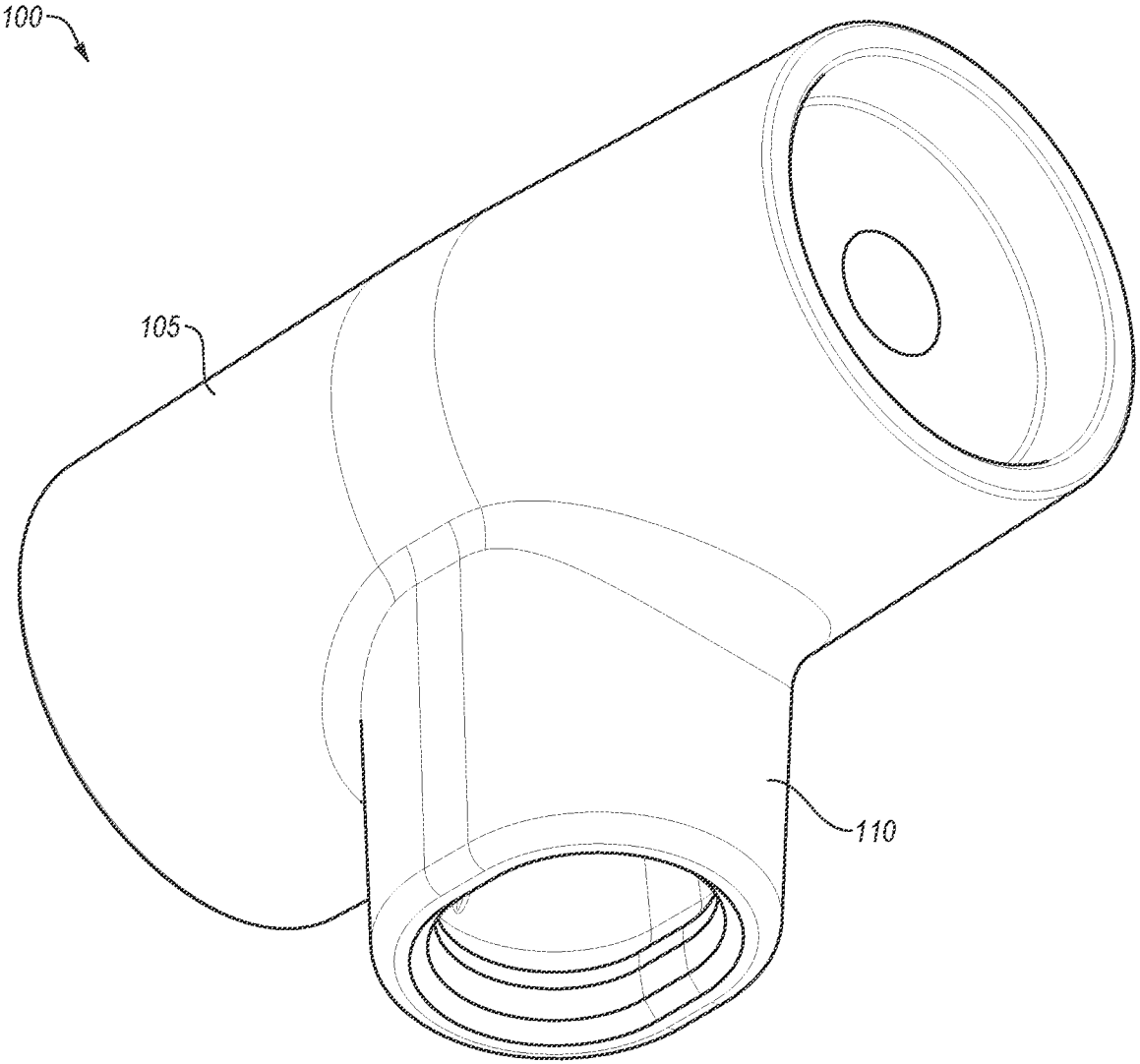
FIG. 1B illustrates a lower, perspective view of an example dead blow hammer head, according to one or more embodiments of the present disclosure.
Figure 1C:
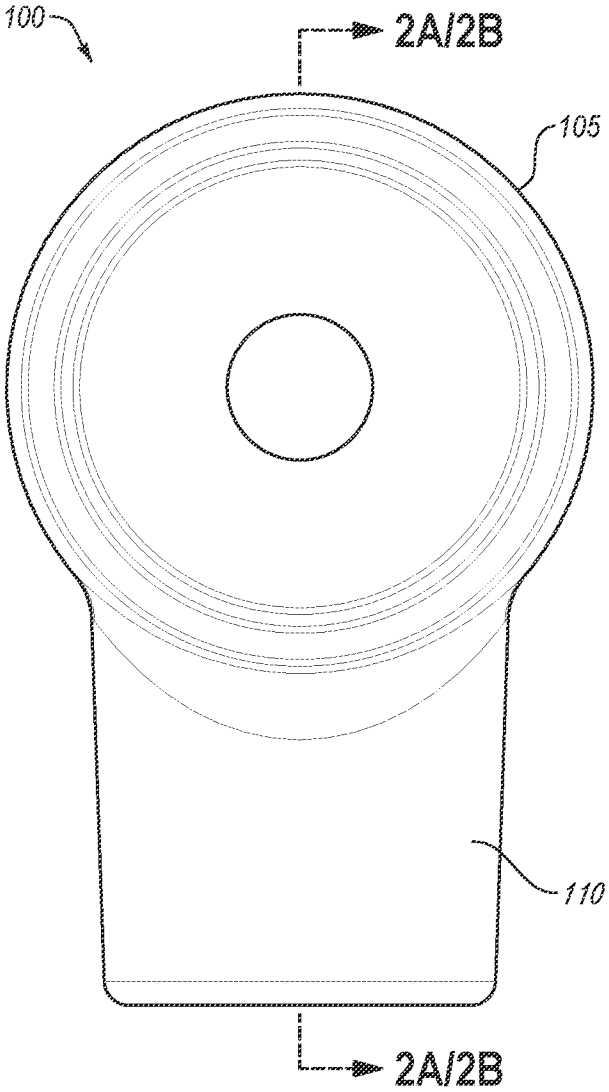
FIG. 1C illustrates a side view of an example dead blow hammer head, according to one or more embodiments of the present disclosure.
Figure 1D:
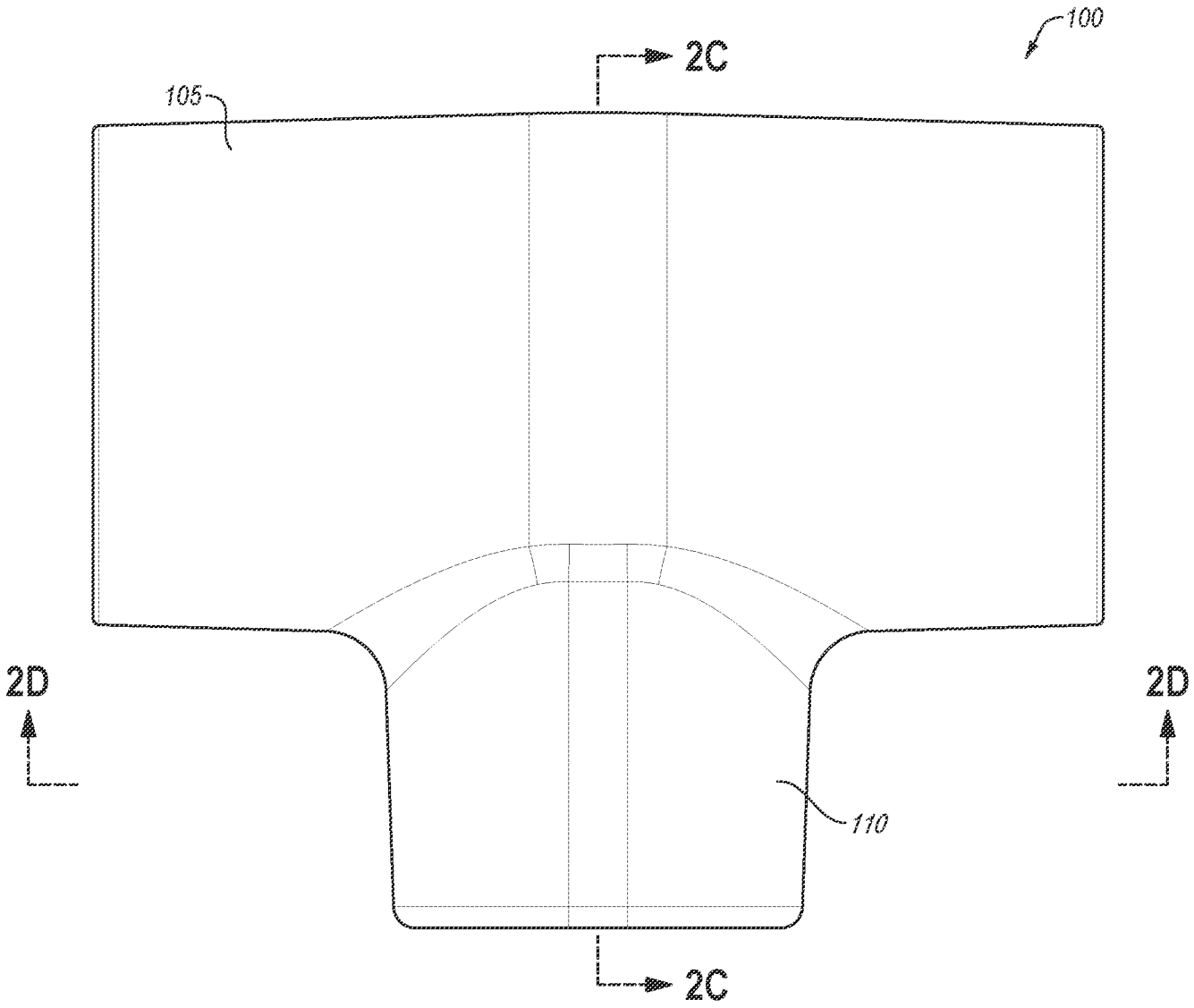
FIG. 1D illustrates a front view of an example dead blow hammer head, according to one or more embodiments of the present disclosure.

Some hammers include a handle and a hammer head that may be separate objects. The handle may be coupled to the hammer head to form the hammer using various techniques. For example, coupling a handle to a hammer head may include expanding a portion of the handle within a portion of the hammer head such that the portion of the handle may be constricted within the hammer head. Some hammers are arranged such that the portion of the handle may be accessible for manipulation after being inserted into the hammer head. For example, a handle inserted into a hammer head may extend from a first side of the hammer head to a second side of the hammer head (e.g., through an aperture or handle channel of the hammer head) and the handle on the second side of the hammer head may be configured to receive an expansion device (e.g., a wedge or other expansion device).

After a period of use, the handle may become loose within the hammer head which may cause a user to replace the handle and/or replace the hammer. In instances in which a user replaces a handle, the user may insert a new expansion device in the handle after inserting the handle into the hammer head. Some hammers may provide a user limited access to the handle after the handle is inserted into the hammer head, such as a limited opportunity to apply an expansion device to constrict the handle within the hammer head. For example, a dead blow hammer may not support a handle passing through the hammer head when the handle is inserted into the hammer head. For example, a dead blow hammer may include a cavity within the dead blow hammer head to retain filler material which may distribute the striking force of the dead blow hammer. In such instances, the dead blow hammer may not support a handle passing through the dead blow hammer head as the handle may disrupt the flow of the filler material within the cavity, which may frustrate at least one use of the dead blow hammer. As such, an expansion device may not be added to the handle after insertion to constrict the handle within the hammer head.

According to one or more embodiments of the present disclosure, a hammer head may include one or more wedges disposed within a channel of the hammer head. The wedges within the channel of the hammer head may engage one or more slotted portions of a handle at a handle end thereof, such that the handle may be expanded and/or constricted within the channel of the hammer head. As such, the handle may be tightened within the hammer head via the wedges without the handle entering and/or passing through a center portion of the hammer head (e.g., a cavity portion in instances in which the hammer head is a dead blow hammer head). In some embodiments, the wedges within a hammer head may provide a constricting force to a handle regardless of whether the handle end is accessible to a user or not. For example, in instances in which the hammer head is a dead blow hammer head, the wedges within the channel of the hammer head may provide a constricting force to the handle within the channel of the hammer head including instances where the end of the handle may not be accessible for a user to apply a wedge or other expansion device to the handle, such as via a top portion of the handle that may have passed through the hammer head to be accessible on an open, top portion of the hammer head.

In some embodiments, one or more aspects of the present disclosure may facilitate adding an adhesive adjacent to the handle and/or the hammer head, which may contribute to retaining the handle within the hammer head. For example, the hammer head may include one or more channels that may support adding an adhesive between the hammer head and the handle after the handle may be inserted within the hammer head. In another example, the hammer head may include one or more pockets that may be disposed adjacent to an inserted handle, and the pockets may receive an adhesive which may contribute to bonding the handle to the hammer head. In these or other embodiments, the wedges within the channel of the hammer head and the pockets configured to receive an adhesive may contribute to retaining a handle inserted into the hammer head.

Embodiments of the present disclosure will be explained with reference to the accompanying drawings.

FIGS. 1A-1D illustrate an example dead blow hammer head 100 (or "hammer head 100"), according to one or more embodiments of the present disclosure. The hammer head 100 may include a first cylindrical body 105 and a second cylindrical body 110.

In some embodiments, the hammer head 100 may have a substantially tee-shaped structure. For example, the hammer head 100 may have an appearance of a first cylindrical body 105 coupled orthogonally to a second cylindrical body 110. In some embodiments, the hammer head 100 may be produced using a mold such that the hammer head 100 may include a uniform structure and/or material, such that the hammer head 100 may not include welding and/or other bonding techniques.

In some embodiments, the hammer head 100 may be formed by injection molding where a material may be injected into a mold to form the hammer head 100, such that the shape and/or the components included in the hammer head 100 may be formed of a uniform structure and/or material (e.g., the first cylindrical body 105 may be joined with the second cylindrical body 110 without employing a bonding process, such as welding). For example, a hammer head mold having the shape and/or features of the hammer head 100 may receive a molten metal, such as iron, steel, etc., and the molten metal injected into the hammer head mold may produce the hammer head 100 having a uniform structure and material. In another example, a hammer head mold having the shape and/or features of the hammer head 100 may receive a liquified thermoplastic polymer material, such as elastomers, thermosetting polymers, etc., and the molten metal injected into the hammer head mold may produce the hammer head 100 having a uniform structure and material.

Alternatively, or additionally, the first cylindrical body 105 and the second cylindrical body 110 may be coupled together such that the coupled first cylindrical body 105 and the second cylindrical body 110 form the hammer head 100, where the coupling may use one or more bonding processes. For example, the second cylindrical body 110 may be welded to the first cylindrical body 105 to form the hammer head 100. In these or other embodiments, the first cylindrical body 105 may be orthogonal to the second cylindrical body 110. For example, as discussed herein FIG. 2B may illustrate a first center line 250 through a circular cross-section of the first cylindrical body 105 that may be orthogonal to a second center line 255 through a circular cross-section of the second cylindrical body 110.

Modifications, additions, or omissions may be made to the hammer head 100 without departing from the scope of the present disclosure. For example, in some embodiments, the hammer head 100 may include a cavity disposed therein, such as within the first cylindrical body 105, as described relative FIGS. 2A-2B. Alternatively, in some embodiments, the hammer head 100 may be solid, such as throughout the first cylindrical body 105. In some embodiments, the hammer head 100 and/or the components thereof (e.g., the first cylindrical body 105 and/or the second cylindrical body 110) may include other shapes, orientations relative to one another, bonding processes, and the like. Alternatively, or additionally, the hammer head 100 may include any number of other components that may not be explicitly illustrated or described.

Figure 2A:
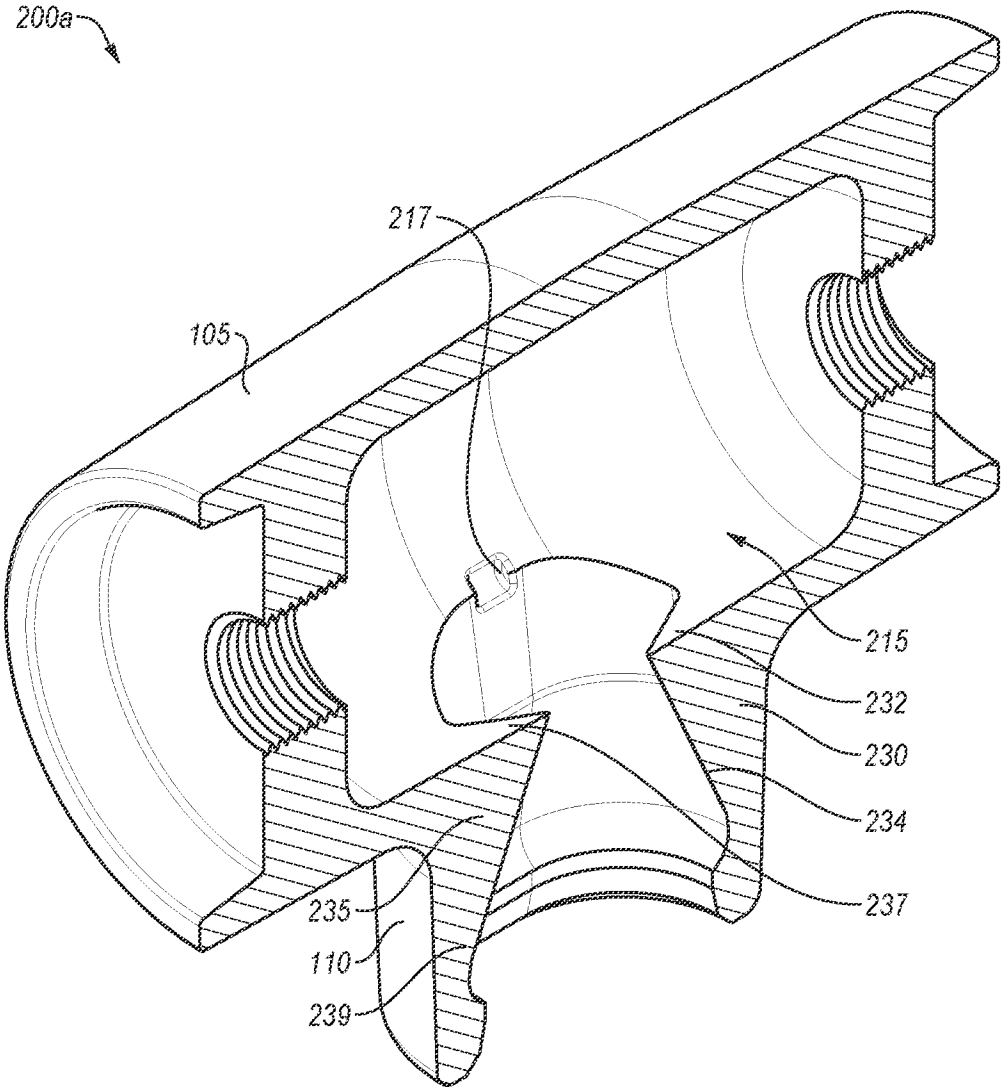
FIG. 2A illustrates a cutaway perspective view of an example dead blow hammer head, according to one or more embodiments of the present disclosure.
Figure 2B:
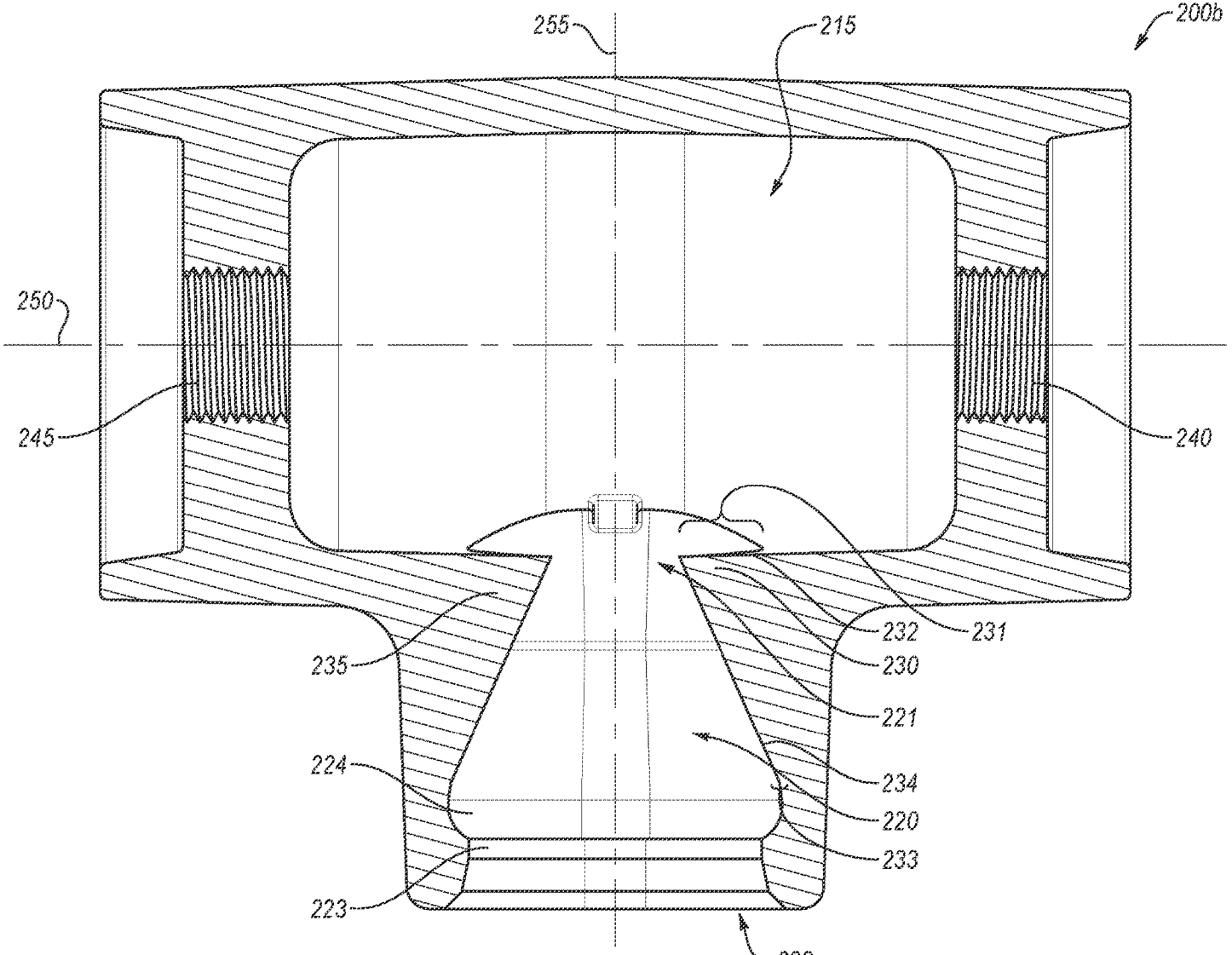
FIG. 2B illustrates a front cross-sectional view of an example dead blow hammer head, according to one or more embodiments of the present disclosure.
Figure 2C:
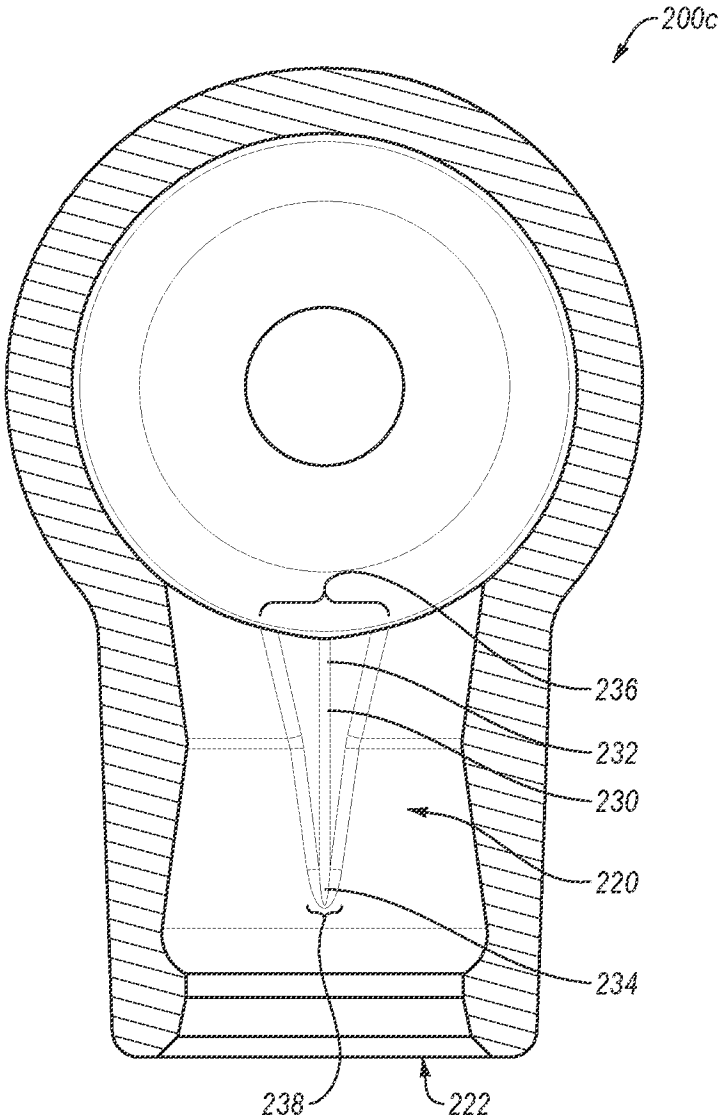
FIG. 2C illustrates a side cross-sectional view of an example dead blow hammer head, according to one or more embodiments of the present disclosure.
Figure 2D:
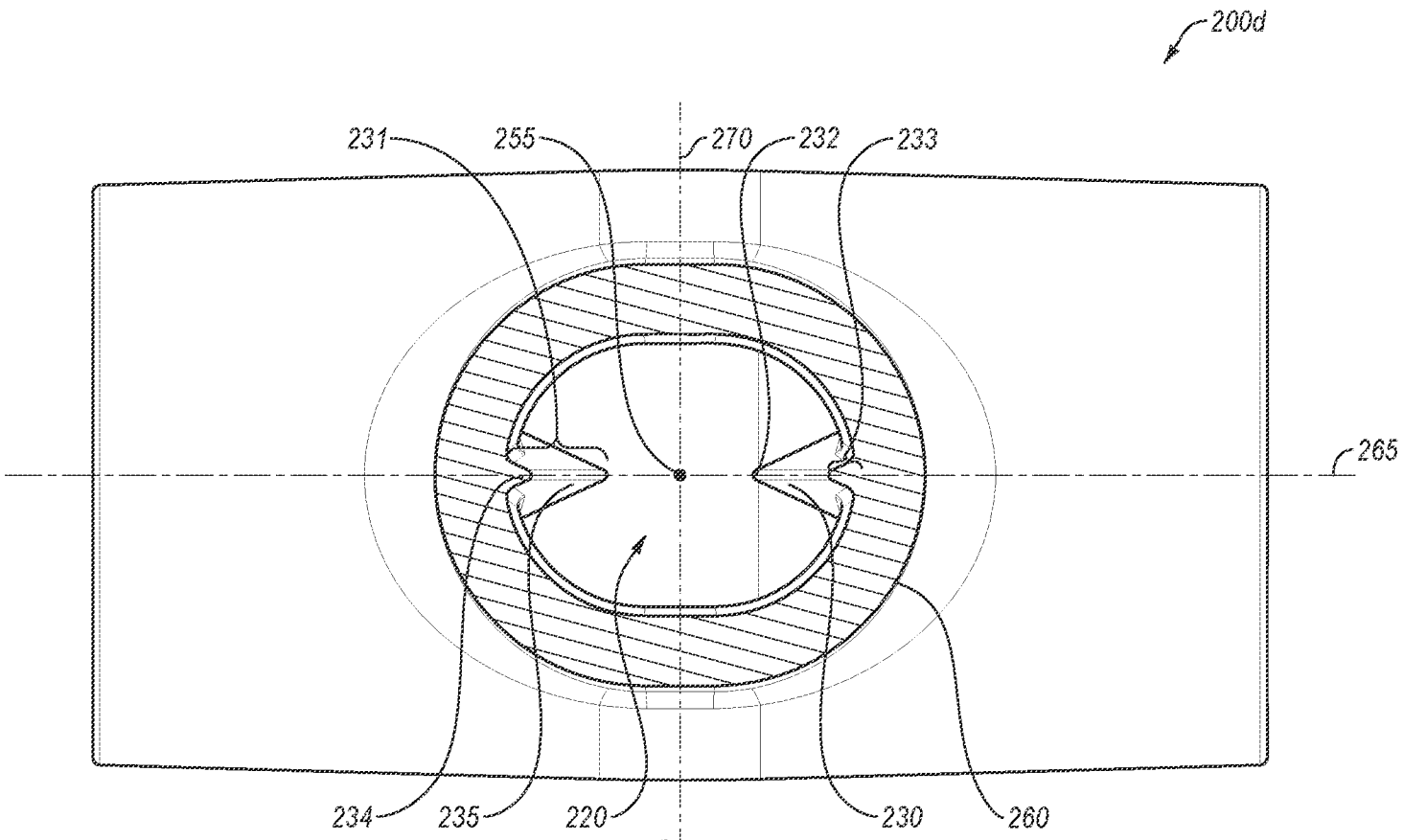
FIG. 2D illustrates a bottom cross-sectional view of an example dead blow hammer head, according to one or more embodiments of the present disclosure.

FIG. 2A illustrates a cutaway perspective view of an example dead blow hammer head 200*a*, according to one or more embodiments of the present disclosure. FIGS. 2B-2D illustrate various cross-sectional views of an example dead blow hammer heads 200*b*, 200*c*, and 200*d*, respectively, according to one or more embodiments of the present disclosure. The dead blow hammer heads 200*a*, 200*b*, 200*c*, and 200*d* may be referred to collectively as a dead blow hammer head 200, or hammer head 200. The hammer head 200 may be the same or similar as the hammer head 100 of FIGS. 1A-1D, which may include the first cylindrical body 105 and the second cylindrical body 110. The hammer head 200 may include a cavity 215, one or more pockets 217, a receptacle channel 220, a first wedge 230, a second wedge 235, a first channel 240, a second channel 245, a first center line 250, a second center line 255, and a receptacle cross-section 260, as shown in FIGS. 2A-2D. The first wedge 230 may include a first upper portion 232 and a first lower portion 234. The second wedge 235 may include a second upper portion 237 and a second lower portion 239. The receptacle channel 220 may include a first receptacle end 221, a second receptacle end 222, a first receptacle midportion 223, and a second receptacle midportion 224.

In some embodiments, the cavity 215 may be disposed within the first cylindrical body 105. The cavity 215 may be configured to hold a filler material (not illustrated) within the hammer head 200, such as steel shot, other metallic shot, sand, and/or other filler material. In some embodiments, the cavity 215 may include a shape similar to the first cylindrical body 105. For example, the cavity 215 may include a substantially cylindrical shape within the first cylindrical body 105. Alternatively, or additionally, the cavity 215 may include any shape that may be contained within the first cylindrical body 105.

In some embodiments, the pockets 217 may be disposed within the cavity 215 and/or adjacent to the first receptacle end 221 of the receptacle channel 220. For example, the pockets 217 may be disposed within the cavity 215 along a minor axis 270 of the receptacle cross-section 260 (as shown in FIG. 2D) and/or at the ends of the minor axis 270 of the receptacle cross-section 260. Alternatively, or additionally, the pockets 217 may be disposed adjacent to the receptacle channel 220 and/or along the minor axis 270 of the receptacle cross-section 260, such that the pockets 217 may extend from the first receptacle end 221 (e.g., adjacent to the 232) toward the second receptacle end 222 (e.g., adjacent to the first receptacle midportion 223), along the minor axis 270 of the receptacle cross-section 260. For example, the pockets 217 may be parallel to the receptacle channel 220 along the minor axis 270 from approximately the first receptacle end 221 to the second receptacle end 222. In these or other embodiments, the pockets 217 may be configured to receive an adhesive that may be used to couple a handle to the hammer head 200, as described herein.

Figure 3A:
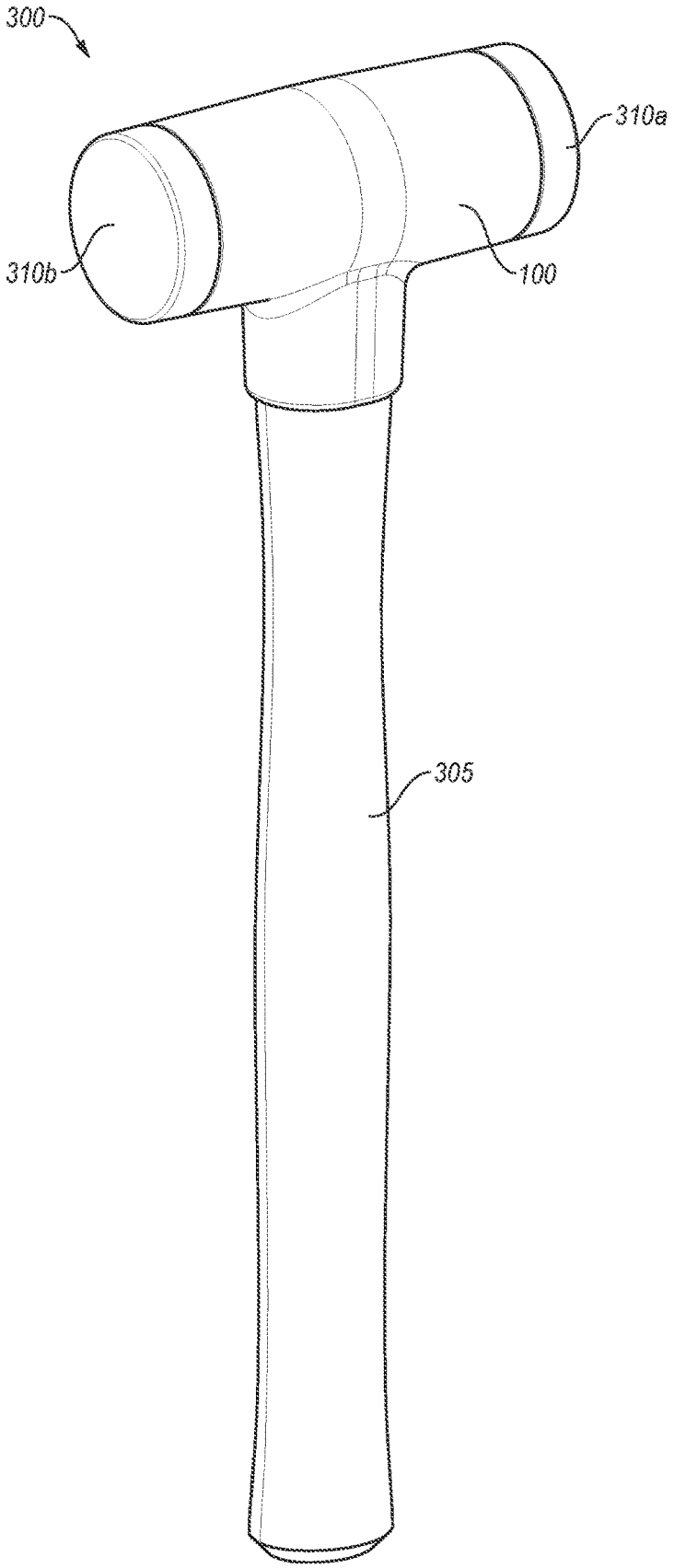
FIG. 3A illustrates an example dead blow hammer, according to one or more embodiments of the present disclosure.

Referring to FIG. 2B which illustrates a front cross-sectional view of the dead blow hammer head 200*b*, in some embodiments, the cavity 215 may be connected to the receptacle channel 220 such that the first receptacle end 221 may be proximate to the cavity 215. For example, the cavity 215 may include an opening adjacent to the receptacle channel 220 such that the cavity 215 may be connected to the receptacle channel 220. Alternatively, or additionally, the cavity 215 may be sealed relative to the receptacle channel 220 such that no opening between the cavity 215 and the receptacle channel 220 may be present. Alternatively, or additionally, the opening between the cavity 215 and the receptacle channel 220 may be sealed by an object that may be inserted into the receptacle channel 220, such as a handle (e.g., the handle 305 as illustrated in FIG. 3A). Additional details related to the handle 305 and the relationship between the handle 305 and the hammer head 200 (or the hammer head 100) may be further discussed herein, for example, relative to FIGS. 3A-3B.

In some embodiments, the receptacle channel 220 may extend from the first receptacle end 221 (e.g., proximate to the cavity 215) to the second receptacle end 222, which may be distant from the cavity 215, or further away from the cavity 215 relative to the first receptacle end 221. In some embodiments, the second receptacle end 222 may be connected to the first receptacle midportion 223, the first receptacle midportion 223 may be connected to the second receptacle midportion 224, and the second receptacle midportion 224 may be connected to the first receptacle end 221. In some embodiments, the first receptacle end 221, the second receptacle midportion 224, the first receptacle midportion 223, and the second receptacle end 222, and the connection therebetween as described herein, may partially, substantially, or fully form the receptacle channel 220.

In some embodiments, the second receptacle end 222 may have a first opening that may be wider than a second opening of the first receptacle midportion 223. For example, the first opening may have a first diameter and the second opening may have a second diameter, where the first diameter may be greater than the second diameter. In some embodiments, the first opening of the second receptacle end 222 may include a first transition to the second opening of the first receptacle midportion 223. For example, the first transition between the first opening and the second opening may include a taper, a chamfer, a bevel, one or more steps, and the like.

In some embodiments, the second receptacle midportion 224 may have a third opening that may be greater than the second opening of the first receptacle midportion 223. In some embodiments, the third opening of the second receptacle midportion 224 may include a second transition to the second opening of the first receptacle midportion 223. For example, the second transition between the second opening and the third opening may include a taper, a chamfer, a bevel, one or more steps, and the like.

In some embodiments, the first receptacle end 221 may have a fourth opening that may be less than or equal to the third opening of the second receptacle midportion 224. In some embodiments, the third opening of the second receptacle midportion 224 may include a third transition to the fourth opening of the first receptacle end 221. For example, the third transition between the third opening and the fourth opening may include a taper, a chamfer, a bevel, one or more steps, and the like. In instances in which the third opening and the fourth opening are similar in size, the third transition may be a double taper, such that the third transition may initially have a narrowing taper and then have a widening taper (e.g., in either direction between the fourth opening of the first receptacle end 221 and the third opening of the second receptacle midportion 224).

In some embodiments, the cavity 215 may be connected to the first channel 240 and/or the second channel 245 where the first channel 240 and/or the second channel 245 may be oriented parallel to the first center line 250 and/or oriented orthogonally to the second center line 255. For example, as illustrated in FIG. 2B, the first channel 240 and/or the second channel 245 may connect to the cavity 215 and may extend laterally and/or in the direction of the first center line 250 and/or away from the second center line 255. In some embodiments, the first channel 240 and the second channel 245 may be coaxially aligned. For example, a center point of the first channel 240 and a center point of the second channel 245 may be aligned along an axis that may pass through the center of the cavity 215, such as the first center line 250.

In some embodiments, a first diameter associated with the first channel 240 and/or a second diameter associated with the second channel 245 may individually be less than a third diameter associated with the cavity 215. In some embodiments, the first diameter associated with the first channel 240 may be the same or approximately the same as the second diameter associated with the second channel 245.

In some embodiments, a line defined between the first channel 240 and the second channel 245 (e.g., the first center line 250) may be parallel or substantially parallel to a major axis 265 of the receptacle cross-section 260. For example, the major axis 265 of the receptacle cross-section 260 may be oriented in a first direction and a line between the first channel 240 and the second channel 245 (e.g., the first center line 250) may be oriented in the first direction.

In some embodiments, as illustrated in FIG. 2A, the first channel 240 and/or the second channel 245 may be threaded. In some embodiments, the first channel 240 and/or the second channel 245 may be configured to individually receive a threaded connector that may be associated with an individual striking face. For example, the first channel 240 may be threaded and may be configured to receive a first threaded connector of a first striking face (e.g., the first striking face 310*a* of FIGS. 3A-3B) and the second channel 245 may be threaded and may be configured to receive a second threaded connector of a second striking face (e.g., the second striking face 310*b* of FIGS. 3A-3B).

The first wedge 230 and/or the second wedge 235 may be displayed and discussed herein relative to FIGS. 2A-2D. Each of the figures FIGS. 2A-2D individually include various views and/or aspects associated with the first wedge 230 and/or the second wedge 235 and some figures may provide a better visual indication of aspects of the first wedge 230 and/or the second wedge 235 than another figure. For example, FIG. 2C, which illustrates a side cross-sectional view of the dead blow hammer head 200*c*, may provide a better view of the substantially "V" shaped characteristic of the first wedge 230 and/or the second wedge 235 than FIGS. 2A-2B.

In some embodiments, the first wedge 230 and/or the second wedge 235 may be disposed within the receptacle channel 220 (see FIGS. 2A, 2B, and 2D). As shown in FIG. 2D which illustrates a bottom cross-sectional view of the dead blow hammer head 200*d*, in some embodiments, the first wedge 230 may be disposed on a first end of the major axis 265 of the receptacle cross-section 260 and the second wedge 235 may be disposed on a second end of the major axis 265 of the receptacle cross-section 260. The first end of the major axis 265 of the receptacle cross-section 260 (e.g., where the first wedge 230 may be disposed) may be opposite the second end of the major axis 265 (e.g., where the second wedge 235 may be disposed).

As illustrated in FIGS. 2A, 2C, and 2D, in some embodiments, the first wedge 230 may have a first upper portion 232 that may be proximate to the cavity 215 (e.g., proximate to the first receptacle end 221) and may have a first lower portion 234 that may be distant from the cavity 215 (e.g., proximate to the second receptacle end 222).

As illustrated in FIGS. 2A, 2B, and 2D (and most clearly in FIG. 2B) in some embodiments, the first upper portion 232 may protrude from the surface of the receptacle channel 220 (e.g., toward the second center line 255) a first distance 231 (illustrated in FIGS. 2B and 2D) and the first lower portion 234 may protrude from the surface of the receptacle channel 220 a second distance 233 which may be less than the first distance 231. Stated another way, the first distance 231 associated with the first upper portion 232 extending along the major axis 265 of the receptacle cross-section 260 from the surface of the receptacle channel 220 may be more than the second distance 233 associated with the first lower portion 234. For example, the first upper portion 232 may protrude from the surface of the receptacle channel 220 (e.g., into a center portion of the receptacle channel 220) more than the first lower portion 234, and the first wedge 230 may be tapered from the first upper portion 232 to the first lower portion 234 (e.g., as illustrated in FIGS. 2A and 2B).

As illustrated in FIG. 2C, in some embodiments, the first upper portion 232 may include a first width 236 that may be greater than a second width 238 of the first lower portion 234. The first width 236 and the second width 238 may be relative to the minor axis 270 of the receptacle cross-section 260. Stated another way, when viewing the first wedge 230 from the side, such as the view of FIG. 2C, the first upper portion 232 may be wider than the first lower portion 234, such that the first wedge 230 may be substantially "V" shaped.

In some embodiments, the second wedge 235 may have a second upper portion 237 that may be proximate to the cavity 215 (e.g., proximate to the first receptacle end 221) and may have a second lower portion 239 that may be distant from the cavity 215 (e.g., proximate to the second receptacle end 222).

In some embodiments, the second upper portion 237 may protrude from the surface of the receptacle channel 220 (e.g., toward the second center line 255) a first length and the second lower portion 239 may protrude from the surface of the receptacle channel 220 a second length which may be less than the first length. Stated another way, the second upper portion 237 may be wider along the major axis 265 of the receptacle cross-section 260 than the second lower portion 239. For example, the second upper portion 237 may protrude from the surface of the receptacle channel 220 more than the second lower portion 239, and the second wedge 235 may be tapered from the second upper portion 237 to the second lower portion 239.

In some embodiments, the second upper portion 237 may be wider along the minor axis 270 of the receptacle cross-section 260 than the second lower portion 239. Stated another way, when viewing the first wedge 230 along the major axis 265 of the receptacle cross-section 260, the second upper portion 237 may be wider than the second lower portion 239, such that the second wedge 235 may be substantially "V" shaped.

Referring to FIG. 2D, in some embodiments, the receptacle cross-section 260 of the receptacle channel 220 may have a substantially elliptic shape. Alternatively, the receptacle cross-section 260 of the receptacle channel 220 may have a substantially oval shape. For example, the receptacle cross-section 260 may be substantially parallel to the first center line 250 and viewing the receptacle channel 220 from the second receptacle end 222, the receptacle channel 220 may have an elliptic shape or an oval shape. In some embodiments, the second center line 255 may be a center line through the receptacle cross-section 260.

Modifications, additions, or omissions may be made to the hammer head 200 without departing from the scope of the present disclosure. For example, in some embodiments, the hammer head 200 may include more or less wedges than the first wedge 230 and the second wedge 235. For example, in some embodiments, only the first wedge 230 may be included in the hammer head 200. Alternatively, or additionally, the hammer head 200 may include three, four, or more wedges, such as wedges disposed on the ends of the major axis 265 of the receptacle cross-section 260 (e.g., as illustrated in FIG. 2D) and wedges disposed on the ends of the minor axis 270 of the receptacle cross-section 260. In these or other embodiments, the number of wedges included in the hammer head 200 may correspond to the configuration of an associated handle (e.g., a number of slots included in the handle to engage the wedges included in the hammer head 200). Alternatively, or additionally, the hammer head 200 may include any number of other components that may not be explicitly illustrated or described.

Figure 3B:
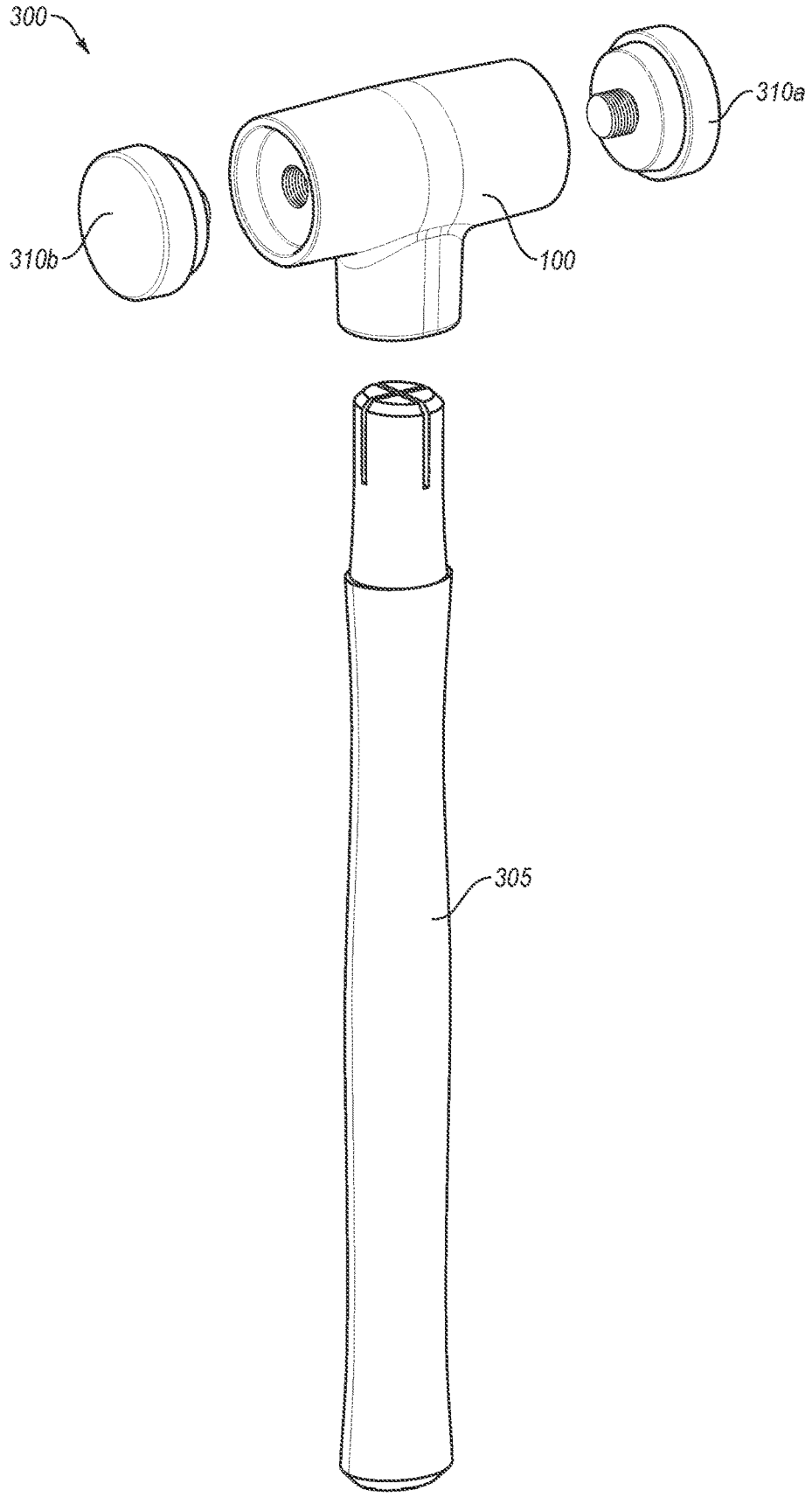
FIG. 3B illustrates an exploded view of an example dead blow hammer, according to one or more embodiments of the present disclosure.

FIGS. 3A-3B illustrate an example dead blow hammer 300 ("hammer 300"), according to one or more embodiments of the present disclosure. The hammer 300 may include a hammer head 100, a handle 305, a first striking face 310*a*, and a second striking face 310*b*, referred to collectively as striking faces 310. The handle 305 may include one or more slotted portions 307. The first striking face 310*a* may include a first threaded connector 312*a* and the second striking face 310*b* may include a second threaded connector 312*b*, referred to collectively as threaded connectors 312.

The hammer head 100 may be the same or similar as the hammer head 100 of FIGS. 1A-1D and/or may include some or all of the features of the hammer head 200 illustrated and/or described relative to FIGS. 2A-2D.

In some embodiments, the handle 305 may include a material that may be the same or similar as the material included in the hammer head 100. For example, in instances in which the hammer head 100 is made of steel materials, the handle 305 may include steel materials. Alternatively, or additionally, the material of the handle 305 may differ from the material included in the hammer head 100. For example, in instances in which the hammer head 100 is made of steel materials, the handle 305 may include wood, plastic, carbon fiber, and/or other materials that may differ from the material included in the hammer head 100. In these or other embodiments, the handle 305 may include a covering (not illustrated) that may cover some or all of the handle 305. In some embodiments, the covering on the handle 305 may provide a better grip for a user, shock absorption during use, and/or may provide an aesthetic appeal to the hammer 300.

In some embodiments, a hammer head end of the handle 305 configured to interface with the hammer head 100 may include the slotted portions 307. In some embodiments, the slotted portions 307 may be configured to engage one or more wedges included in the hammer head 100, such as the first wedge 230 and/or the second wedge 235 as shown and described relative to FIGS. 2A-2D. In some embodiments, a length of the slotted portions 307 along the hammer head end of the handle 305 may correspond to a length of the one or more wedges with which the slotted portions 307 may engage. For example, the wedges in the hammer head 100 may have a first length (e.g., less than or equal to a length of the receptacle channel 220, measured between a first receptacle end 221 and a second receptacle end 222) and the slotted portions 307 may have the first length. Alternatively, or additionally, the length of the slotted portions 307 may be longer or shorter than the length of the one or more wedges.

In some embodiments, the slotted portions 307 may engage the wedges in the hammer head 100 as the handle 305 may be inserted into a receptacle channel of the hammer head 100. In some embodiments, the shape and/or orientation of the wedges (e.g., an upper portion of the wedge protruding from a surface of the receptacle channel more than a lower portion of the wedge and/or the upper portion of the wedge being wider than the lower portion of the wedge, as described relative to FIGS. 2A-2D) within the hammer head 100 may engage the slotted portions 307 of the handle 305 such that the hammer head end of the handle 305 may be compressed within the hammer head 100. For example, as the wedges engage the slotted portions 307 of the handle 305 (e.g., as the handle 305 is inserted into the receptacle channel of the hammer head 100), the hammer head end of the handle 305 may be spread apart and/or constricted within the surface of the receptacle channel of the hammer head 100, such that a force caused by the constriction of the handle 305 within the hammer head 100 may contribute to retaining connection between the handle 305 and the hammer head 100.

In some embodiments, the striking faces 310 may be coupled and/or decoupled from the hammer head 100 as desired. For example, after a period of use, one or more of the striking faces 310 may be removed (e.g., decoupled) from the hammer head 100 and new striking faces 310 may be coupled to the hammer head 100. In some embodiments, the striking faces 310 may be coupled and/or decoupled via the threaded connectors 312 engaging and/or disengaging a first channel and/or a second channel of the hammer head 100. For example, the threaded connectors 312 may engage a threaded portion of the first channel or the second channel which may contribute to the striking faces 310 coupling and/or decoupling from the hammer head 100.

In some embodiments, removing the striking faces 310 may provide access to a cavity portion of the hammer head 100 via the first channel and/or the second channel. In some embodiments, a filler material may be added to or removed from the cavity of the hammer head 100 via the first channel and/or the second channel. For example, in instances in which the cavity of the hammer head 100 is filled with too much or too little steel shot, an amount of steel shot may be removed or added, respectively, to the cavity of the hammer head 100 via the first channel and/or the second channel.

Alternatively, or additionally, an adhesive may be added to the cavity of the hammer head 100 via the first channel and/or the second channel, which may contribute to retaining the handle 305 within the hammer head 100 after being inserted. For example, the handle 305 may be inserted into the hammer head 100 such that the hammer head end of the handle 305 may be at least partially exposed within the cavity of the hammer head 100. Continuing the example, adhesive may be added into the cavity via the first channel and/or the second channel, such that the adhesive may be adjacent to the hammer head end of the handle 305 and the adhesive may contribute to retaining the handle 305 within the hammer head 100.

In these or other embodiments, an amount of adhesive that may be added to the cavity of the hammer head 100 may at least partially fill one or more pockets disposed within the cavity. For example, in instances in which the pockets are adjacent to the receptacle channel and/or the pockets extend adjacent to the receptacle channel, as described herein, the adhesive may fill at least a portion of the pockets. Alternatively, or additionally, the amount of adhesive added to the cavity may cover at least a portion of the cavity and/or the exposed portion of the handle 305 within the cavity. For example, the adhesive may fill one or more pockets included in the hammer head 100 and/or may fill at least a portion of the cavity of the hammer head 100 in any amount up to the first channel and/or the second channel (e.g., an amount of adhesive that fills the cavity more than up to the first channel and/or the second channel may flow out of the cavity via the first channel and/or the second channel). In another example, an amount of adhesive may fill at least a portion of the cavity to partially, substantially, or completely cover a portion of the handle 305 that may be partially exposed within the cavity of the hammer head 100, such that upon setting/curing, the adhesive may form a substantially smooth base within the cavity which may facilitate unimpeded movement of filler material (e.g., steel shot, as described herein) within the cavity of the hammer head 100 during use of the hammer 300.

Modifications, additions, or omissions may be made to the hammer 300 without departing from the scope of the present disclosure. For example, the slotted portions 307 in the handle 305 may be more or less than illustrated in FIG. 3B and/or may be associated with the number of wedges included in the hammer head 100. In some embodiments, the number of slotted portions 307 may be equal to or greater than the number of wedges included in the hammer head 100. For example, in instances in which the hammer head 100 includes two wedges, the slotted portions 307 included in the handle 305 may be two or more. Alternatively, or additionally, the hammer 300 may include any number of other components that may not be explicitly illustrated or described.

Figure 4:
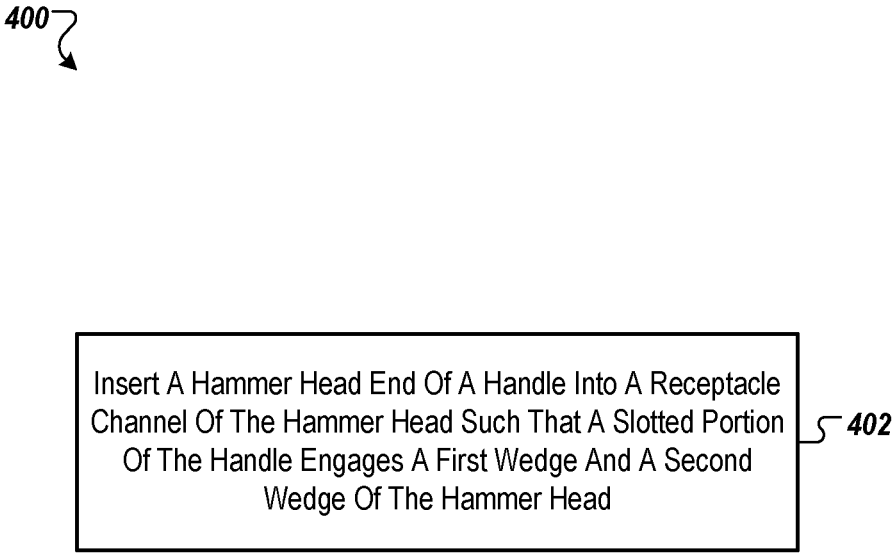
FIG. 4 is a flowchart of an example method of fastening a handle to a dead blow hammer head according to one or more embodiments of the present disclosure.

FIG. 4 is a flowchart of an example method 400 of fastening a handle to a hammer head, in accordance with at least one embodiment of the present disclosure. Although illustrated as discrete blocks, various blocks may be divided into additional blocks, combined into fewer blocks, or eliminated, depending on the desired implementation.

The method 400 may begin at block 402 where a hammer head end of a handle (e.g., the handle 305 of FIG. 3A) may be inserted into a receptacle channel (e.g., the receptacle channel 220 of FIG. 2B) of the hammer head (e.g., the hammer head 100 of FIG. 1A) such that a slotted portion (e.g., the slotted portions 307 of FIG. 3B) of the handle may engage a first wedge (e.g., the first wedge 230 of FIG. 2A) and a second wedge (e.g., the second wedge 235 of FIG. 2A) of the hammer head. As described, the handle may be the same or similar as the handle 305 of FIG. 3A and/or the hammer head may be the same or similar as the hammer head 100 of FIG. 1A. Alternatively, or additionally, the hammer head may further include a first channel (e.g., the first channel 240 of FIG. 2B) and/or a second channel (e.g., the second channel 245 of FIG. 2B) where the first channel may be connected to a cavity (e.g., the cavity 215 of FIG. 2A), may be oriented orthogonally to a center line (e.g., the second center line 255 of FIG. 2B) through a receptacle cross-section (e.g., the receptacle cross-section 260 of FIG. 2D) of the hammer head, and may be disposed in a first lateral direction relative to the cavity. The second channel may be connected to the cavity and disposed on an opposite side of the cavity relative to the first channel in a second lateral direction.

In some embodiments, the method may include injecting an adhesive through the first channel and/or the second channel of the hammer head. The adhesive may be injected into the cavity and/or one or more pockets (e.g., the pockets 217 of FIG. 2A) that may be configured to receive the adhesive. In some embodiments, the pockets may be disposed at least along a minor axis of the receptacle cross-section and/or the pockets may be adjacent to the cavity.

In some embodiments, in response to the adhesive being injected, the method may include attaching a first striking face (e.g., the first striking face 310*a* of FIG. 3A) to the hammer head via the first channel. The first striking may have a first threaded connector that may be configured to attach to a threaded portion of the first channel. The method may also include attaching a second striking face (e.g., the second striking face 310*b* of FIG. 3A) to the hammer via the second channel. The second striking may have a second threaded connector that may be configured to attach to a threaded portion of the second channel.

Modifications, additions, or omissions may be made to the method 400 without departing from the scope of the present disclosure. For example, in some embodiments, the method 400 may include any number of other components that may not be explicitly illustrated or described.

Terms used in the present disclosure and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. Additionally, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B" even if the term "and/or" is used elsewhere.

All examples and conditional language recited in the present disclosure are intended for pedagogical objects to aid the reader in understanding the present disclosure and the concepts contributed by the inventor to furthering the art, and are to be construed as being without limitation to such specifically recited examples and conditions. Although embodiments of the present disclosure have been described in detail, various changes, substitutions, and alterations could be made hereto without departing from the spirit and scope of the present disclosure.

What is claimed is:

1. A hammer head comprising:

a cavity;

a receptacle channel connected to the cavity and having a first receptacle end proximate to the cavity and open to the cavity, the receptacle channel sized and shaped to receive a handle, and a receptacle cross-section of the receptacle channel having an elliptic shape;

a first channel connected to the cavity, oriented orthogonally to a center line through the receptacle cross-section and disposed in a first lateral direction relative to the cavity, wherein the first channel is threaded and configured to receive a first threaded connector of a first striking face;

a first wedge protruding into the receptacle channel, wherein:

the first wedge has a first upper portion that is proximate to the cavity, a first integrated end of the first wedge is cast into a first receptacle side of the receptacle channel that is disposed at a first end of a major axis of the receptacle cross-section, and the first upper portion at the first integrated end is wider along a minor axis of the receptacle cross-section than a first protrusion end of the first upper portion that is opposite the first integrated end along the major axis; and a second wedge protruding into the receptacle channel opposite the first wedge, wherein:

the second wedge has a second upper portion that is proximate to the cavity, a second integrated end of the second wedge is cast into a second receptacle side of the receptacle channel that is disposed at a second end of the major axis, and the second upper portion at the second integrated end is wider along the minor axis than a second protrusion end of the second upper portion that is opposite the second integrated end along the major axis.

2. The hammer head of claim 1, further comprising:

a second channel connected to the cavity and disposed on an opposite side of the cavity relative to the first channel.

3. The hammer head of claim 2, wherein the second channel is threaded and configured to receive a second threaded connector of a second striking face.

4. The hammer head of claim 2, wherein the first channel is coaxially aligned with the second channel.

5. The hammer head of claim 1, wherein a first diameter associated with the first channel is less than a diameter associated with the cavity.

6. The hammer head of claim 2, wherein a line defined between the first channel and the second channel is parallel to the major axis of the receptacle channel.

7. The hammer head of claim 1, wherein the receptacle channel extends from the first receptacle end to a second receptacle end, the second receptacle end being opposite the first receptacle end and distant from the cavity.

8. The hammer head of claim 7, wherein the second receptacle end includes an opening that is wider than a first receptacle midportion and tapers from the second receptacle end to the first receptacle midportion.

9. The hammer head of claim 8, wherein the receptacle channel includes a second receptacle midportion that wider than the first receptacle midportion and tapers from the second receptacle midportion to the first receptacle end.

10. The hammer head of claim 1, further comprising one or more pockets disposed at least along the minor axis of the receptacle cross-section and adjacent to the cavity.

11. The hammer head of claim 1, wherein the first upper portion of the first wedge is wider along the major axis than a first lower portion of the first wedge that is distal to the cavity.

12. The hammer head of claim 1, wherein the first upper portion of the first wedge is wider along the minor axis of the receptacle cross-section than a first lower portion of the first wedge that is distal to the cavity.

13. A hammer comprising:

a handle having a handle cross-section that has an elliptic shape, the handle including a slotted portion along a major axis of the handle cross-section on a hammer head end thereof; and a hammer head comprising:

a cavity;

a receptacle channel connected to the cavity and having a first receptacle end proximate to the cavity and open to the cavity, the receptacle channel sized and shaped to receive the handle, and a receptacle cross-section of the receptacle channel having an elliptic shape;

a first channel connected to the cavity, oriented orthogonally to a center line through the receptacle cross-section and disposed in a first lateral direction relative to the cavity, wherein the first channel is threaded and configured to receive a first threaded connector of a first striking face;

a first wedge protruding into the receptacle channel and wedged into the slotted portion of the handle, wherein:

the first wedge has a first upper portion that is proximate to the cavity, a first integrated end of the first wedge is cast into a first receptacle side of the receptacle channel that is disposed at a first end of a major axis of the receptacle cross-section, and the first upper portion at the first integrated end is wider along a minor axis of the receptacle cross-section than a first protrusion end of the first upper portion that is opposite the first integrated end along the major axis; and a second wedge protruding into the receptacle channel opposite the first wedge and wedged into the slotted portion of the handle, wherein:

the second wedge has a second upper portion that is proximate to the cavity, a second integrated end of the second wedge is cast into a second receptacle side of the receptacle channel that is disposed at a second end of the major axis and the second upper portion at the second integrated end is wider along the minor axis than a second protrusion end of the second upper portion that is opposite the second integrated end along the major axis.

14. The hammer of claim 13, further comprising:

a second channel connected to the cavity and disposed on an opposite side of the cavity relative to the first channel;

and a second striking face configured to attach to the second channel.

15. The hammer of claim 13, further comprising a filler material disposed within the cavity of the hammer head.

16. The hammer of claim 15, wherein the filler material is metal shot.

17. The hammer of claim 13, wherein the hammer head end of the handle is tapered.

18. A method of fastening a handle to a hammer head, the method comprising:

inserting a hammer head end of a handle into a receptacle channel of the hammer head such that a slotted portion of the handle engages a first wedge and a second wedge of the hammer head, wherein:

the handle comprises:

a handle cross-section that has an elliptic shape; and the slotted portion along a major axis of the handle cross-section on the hammer head end;

the hammer head comprises:

a cavity;

the receptacle channel connected to the cavity and having a first receptacle end proximate to the cavity and open to the cavity, the receptacle channel sized and shaped to receive the handle, and a receptacle cross-section of the receptacle channel having an elliptic shape;

a first channel connected to the cavity, oriented orthogonally to a center line through the receptacle cross-section and disposed in a first lateral direction relative to the cavity, wherein the first channel is threaded and configured to receive a first threaded connector of a first striking face;

a second channel connected to the cavity, oriented orthogonally to the center line through the receptacle cross-section and disposed on an opposite side of the cavity relative to the first channel;

the first wedge protruding into the receptacle channel, wherein:

the first wedge has a first upper portion that is proximate to the cavity, a first integrated end of the first wedge is cast into a first receptacle side of the receptacle channel that is disposed at a first end of a major axis of the receptacle cross-section, and the first upper portion at the first integrated end is wider along a minor axis of the receptacle cross-section than a first protrusion end of the first upper portion that is opposite the first integrated end along the major axis; and the second wedge protruding into the receptacle channel opposite the first wedge, wherein:

the second wedge has a second upper portion that is proximate to the cavity, a second integrated end of the second wedge is cast into a second receptacle side of the receptacle channel that is disposed at a second end of the major axis, and the second upper portion at the second integrated end is wider along the minor axis than a second protrusion end of the second upper portion that is opposite the second integrated end along the major axis.

19. The method of claim 18, further comprising injecting an adhesive through the first channel or the second channel of the hammer head and into the cavity and one or more pockets configured to receive the adhesive, the one or more pockets disposed at least along a minor axis of the receptacle cross-section and adjacent to the cavity.

20. The method of claim 19, wherein in response to the adhesive being injected, further comprising:

attaching the first striking face to the hammer head via the first channel; and attaching a second striking face to the hammer head via the second channel, the second striking face having a second threaded connector configured to attach to a threaded portion of the second channel.

* * * * *